United States Patent [19]

Whitfield

[11] Patent Number: 4,573,438

[45] Date of Patent: Mar. 4, 1986

[54] IGNITION SYSTEM

[76] Inventor: Daniel Whitfield, 320 E. Wythe St., Petersburg, Va. 23803

[21] Appl. No.: 473,828

[22] Filed: Mar. 8, 1983

[51] Int. Cl.[4] ..... F02P 7/10

[52] U.S. Cl. ..... 123/146.5 A; 200/27 A; 200/31 A; 200/31 DP

[58] Field of Search ..... 123/638, 640, 649, 146.5 A; 200/27 A, 30 A, 31 R, 31 A, 31 DP

[56] References Cited

U.S. PATENT DOCUMENTS

| | | | |
|---|---|---|---|
| 1,396,868 | 11/1921 | Moses | 123/649 |
| 2,285,107 | 6/1942 | Bohli | 123/640 |
| 2,465,080 | 3/1949 | Fitzsimmons | 123/638 |
| 2,730,583 | 1/1956 | Brunk | 123/146.5 A |
| 3,221,146 | 11/1965 | McAllister | 235/447 |
| 3,250,867 | 5/1966 | Short | 200/27 A |
| 4,180,031 | 12/1979 | Muranaka et al. | 123/640 |
| 4,198,942 | 4/1980 | Kuroda et al. | 123/638 |
| 4,315,487 | 2/1982 | Wyatt | 123/146.5 A |

*Primary Examiner*—Parshotam S. Lall
*Assistant Examiner*—W. R. Wolfe
*Attorney, Agent, or Firm*—Griffin, Branigan & Butler

[57] ABSTRACT

In a motorcycle ignition system where an internal combustion engine includes front and rear cylinders; a circuit breaker comprising superimposed point plates in which a pair of point assemblies are individually adjusted with respect to at least a single control cam; an offset arrangement of the rubbing block or follower on a pivotal point element with respect to the axis of rotation of the operating cam to afford quicker opening and closing of the points; and a plurality of ignition circuits for multiple cylinder engines in which one or a pair of coils are used; one of the point plates and its respective point assembly being usable in a conventional single point, twin tower arrangement.

1 Claim, 11 Drawing Figures

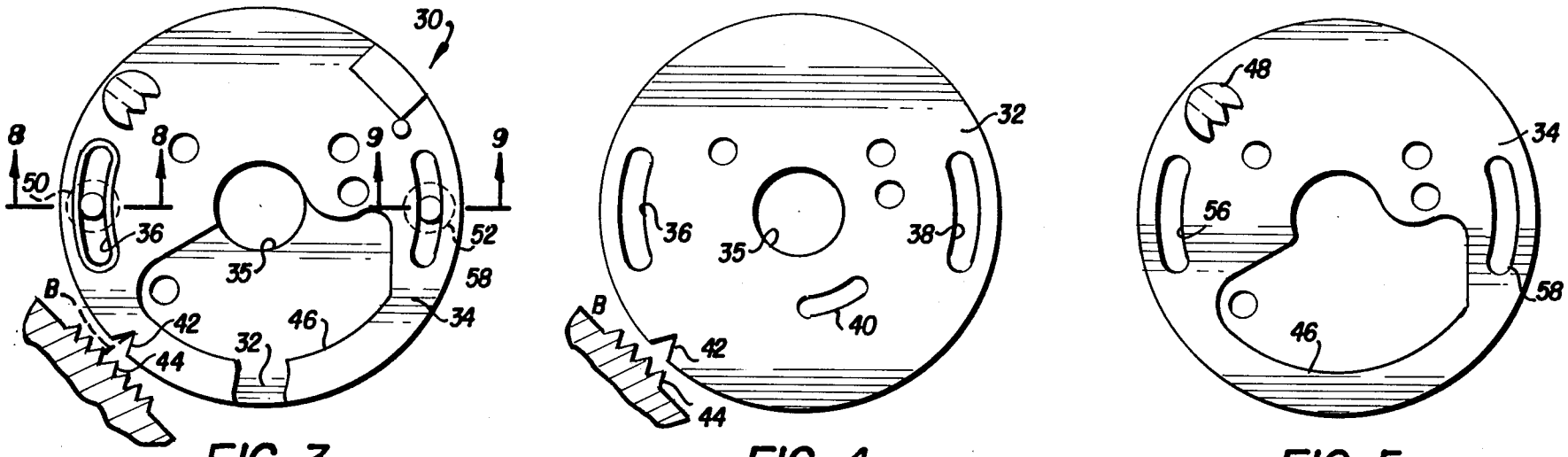
FIG. 3
FIG. 4
FIG. 5
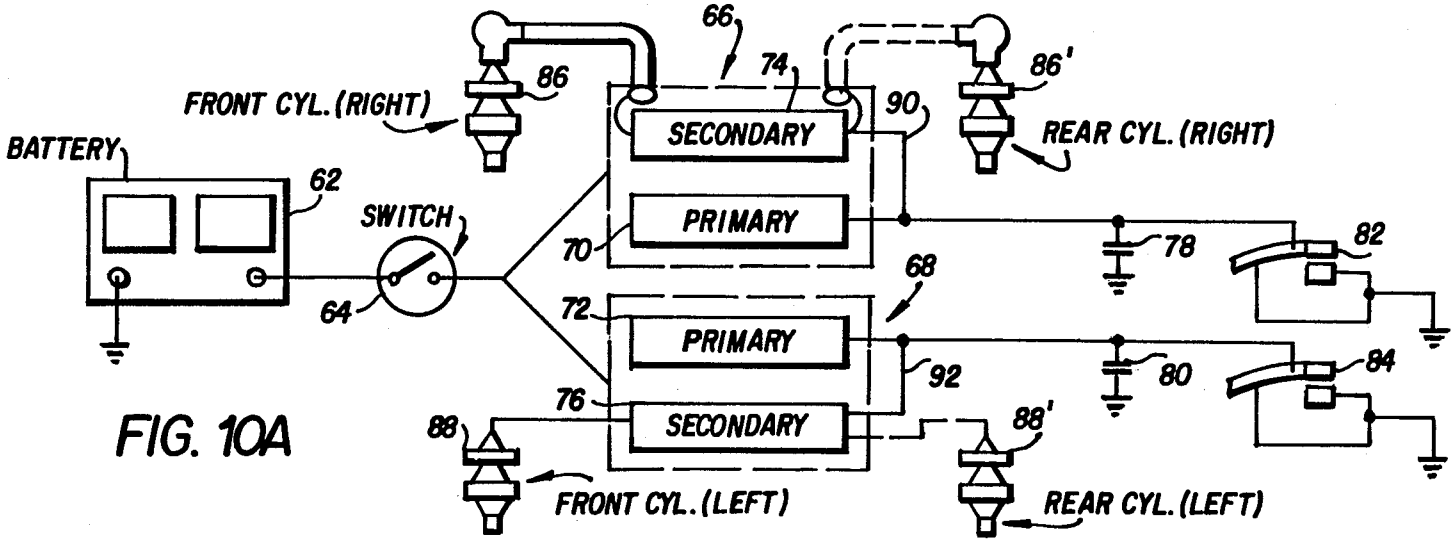
FIG. 10A

IGNITION SYSTEM

BACKGROUND OF THE INVENTION

This invention relates generally to ignition systems for vehicles and is more particularly concerned with improvements in ignition systems for motorcycles.

Most gasoline engines incorporate an ignition system including a source of electricity (battery or magneto), a device to increase the electrical voltage, a breaker to determine the proper timing of electrical impulses, distributor means to send high voltage current to each cylinder of the engine in proper order, a spark plug in each cylinder, and wiring and switches to tie the system together.

In most motorcycle gasoline engines, the primary components of the ignition system comprise a battery, spark coil and distributor. The coil or spark coil generally has a primary coil made up of several hundreds of turns of wire, a soft iron core and this is connected in series to the battery. The secondary coil is generally produced from an extremely fine wire and comprises as many as 10,000 turns around the primary coil; the secondary coil is connected to the distributor. When the flow of low voltage current in the primary coil is momentarily interrupted, a high voltage current, as high as 30,000 volts, can be produced and flows through the secondary coil to the spark plugs.

To break the low voltage current in the primary coil, a pair of breaker points are opened and closed quickly, generally by a rapidly revolving cam, and these breaker points may be opened for as little as five thousandths of a second for each spark being generated. The opening of the points is timed to take place at a moment substantially before the piston reaches the top of the compression stroke of the cylinder, i.e., when the fuel is compressed. A condenser is generally attached to the pair of breaker points to draw off current which might otherwise cause sparking between the rapidly opening points. This condenser helps to provide a clean electrical break which is important in generating the proper spark characteristics. The high-voltage current is necessary to "push" across the fraction-of-an-inch gap of the spark plugs in the engine cylinders and must be hot enough to ingnite the compressed fuel. In engines with large cylinders, such as the Harley Davidson TM motorcycles, for example, it is conventional to use one spark plug in each cylinder. Generally a two lobed cam is used to fire the spark plugs.

Although various types of ignition systems are used in the operation of motor vehicles with small internal combustion engines, the most common ignition system utilizes a circuit breaker block assembly which includes a pair of points which are caused to open and close in synchronization with engine rotation through an integrated rotating shaft upon which a cam is mounted. Typically, these points are electrically connected to open and close the primary winding of an ignition coil. In typical circuit breaker systems, such as that found in the Harley-Davidson TM motorcycle, a single ignition coil fires both spark plugs simultaniously during each complete engine cycle; the first spark occurring immediately before the power stroke and igniting the compressed air/fuel mixture, while the second spark occurs as a consequence of the plugs being connected in series. This system, or variants thereof, have been incorporated in multi-cylinder motorcycle engines particularly since the multi-cylinder engines have provided the greater power and smoother operation than could be obtained through the use of single cylinder engines.

A problem which has manifested itself with the utilization of circuit breaker systems in combination with multi-cylinder engines has been the development of a spark during the intake stroke of the engine. Where the intake gases are ignited in the cylinders, this results in development of fire in the carburetor on the engine, a rough-running and noisy engine, and a reduction of power or efficiency.

This problem has been overcome in large internal combustion engines, through the utilization of a distributor, and attempts have been made to overcome the problem of ignition during an intake stroke of the engine by converting the motorcycle engine ignition system to a distributor-type as is explained in detail in the patent to Wyatt, Sr., et al., U.S. Pat. No. 4,315,487, issued Feb. 16, 1982.

Cylinders of relatively large size are provided with two spark plugs; and the switching mechanism includes dual breaker point assemblies, operated through the use of a lobed breaker cam; illustrative of this type of switching mechanism is the patent to McAllister, U.S. Pat. No. 3,221,116, issued Nov. 30, 1965.

SUMMARY OF THE INVENTION

The present invention provides an ignition system in which, in single-plug mode, more voltage is delivered to the spark plug(s) due to an automotivecoil type of arrangement of primary and secondary windings in series; the current saturation period of the ignition coil as will be described shortly is substantially increased and the wear to the points is substantially reduced due to a 50% reduction in cycles per minute at any given engine speed compared with a single point system. The provision of a substantial increase of the duration of spark existence, time in a dual spark plug per cylinder mode arrangement of this invention allows the two plugs in the same cylinder to fire one after the other; therefore allowing spark to exist in the cylinder for a number of degrees of crankshaft rotation after the original spark and insuring total ignition of any existing fuel/air vapor., This provides a noticeable increase in very high H.P. productivity; a more readily startable internal combustion engine, in which the number of kick-starts per minute, for example, was increased almost 100% through the use of the increased fire-power of the ignition system.

One aspect of the invention provides a circuit breaker assembly for the ignition system in which the follower or rubbing block of the displaceable point of a point assembly, is disposed offset or downstream of the cam lobe whereby opening of the points for energizing the secondary coil of the ignition system, is more forcefuly snapped open than heretofore observed, substantially reducing arcing of the points and providing a quick, clean break of the points at low cranking speeds; and substantially eliminating the possibility of the engine stopping with the points open which causes oxidation of the point contact surface.

Another aspect of the invention in conjunction with that set forth above provides a dual point arrangement, breaker-plate support plates for each of the respective sets of the respective points; the respective plates being superimposed and the lowermost plate carrying a set of points projecting through an accommodating opening in the upper plate; the respective plates being independently adjustable in relation to the optimum advance and firing in relation to TDC (top dead center) of the respective cylinders and the relative positions of the intake and exhaust valves; and independent adjustments of the respective point assemblies, gapping and the like, affording more accurate and smoother operating motorcycle engines; and insuring (with proper timing of each cylinder independently) lower exhaust emissions.

Another aspect of the invention provides a dual coil arrangement with dual sets of points in a high voltage outlet (a lead connectible to a spark plug), connect the ignition circuits of front and rear cylinders, i.e., the primary winding of each coil is connected to a high voltage outlet, and as the pairs of points open and close successively, and the magnetic field of each of the respective coils collapses, the grounded spark plug lead is electrically connected to the collapsing field, thus generating an extremely high and effective voltage at the spark plug being fired.

These, together with other objects and advantages of the invention will become apparent from a consideration of the following descriptions when taken in conjunction with the drawing of exemplary embodiments forming a part thereof, in which:

BRIEF DESCRIPTION OF THE DRAWINGS

FIG. 3 is an enlarged top plan view of superimposed point bases with a portion broken away, and with the respective point assemblies removed for purposes of clarity;

FIG. 4 is a top plan view of the lower point base;

FIG. 5 is a top plan view of the upper point base;

FIGS. 10A and 10B are wiring diagrams of ignition circuits illustrating possible modes of using the invention.

DETAILED DESCRIPTION OF PREFERRED EMBODIMENTS

Figure 1:
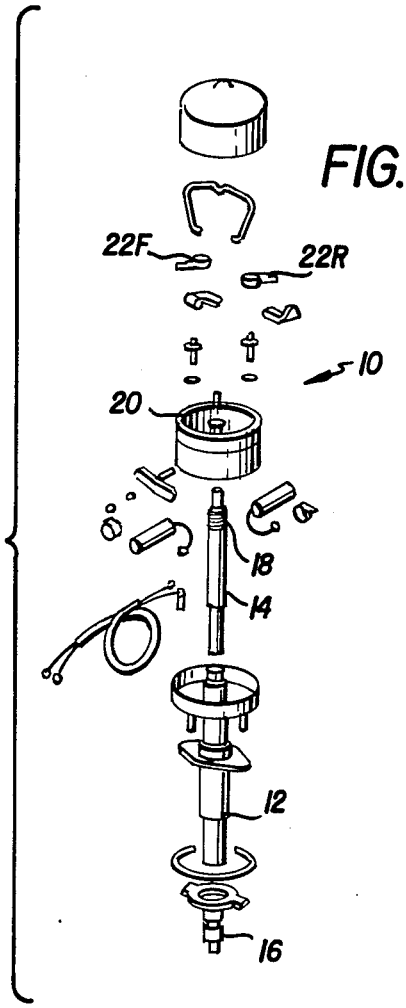
FIG. 1 is an exploded perspective view of a dual point assembly for a multi-cylinder engine illustrating components of a dual breaker contact and operating cam.

Referring to FIG. 1, a dual-point circuit breaker assembly is indicated generally at 10 comprising a lower housing 12 into which a cam shaft 14 depends and which will have mounted on its lower end a drive gear 16 operatively engaged with the engine drive shaft, not shown. The cam 18 of the cam shaft 14 is disposed above the upper surface of a point base 20 upon which are mounted breaker point assemblies 22F and 22R for the respective front and rear cylinders of the engine.

Figure 2:
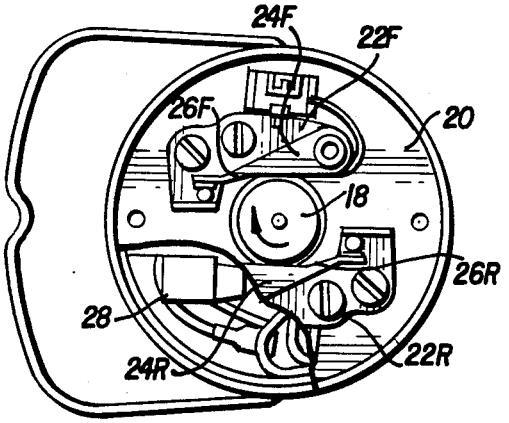
FIG. 2 is a top plan view of dual point assemblies.

Referring to FIG. 2, the point assemmblies 22F and 22R are seen on a larger scale with respect to operating cam 18; it being noted that each of the respective point assemblies includes a pivoting point arm 24F and 24R, respectively, which is normally biased toward the cam, and which includes a follower or rubbing block 26F and 26R, respectively.

Figure 6A:
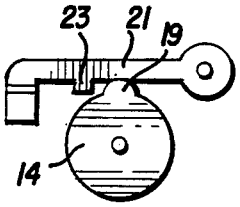
FIG. 6 is a diagrammatic view of the cam lobe of the invention and its relationship to a rubbing block illustrating the downstream offset relation of the points relative to the cam of the cam shaft.
Figure 6B:
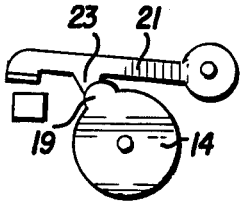
Figure 6C:
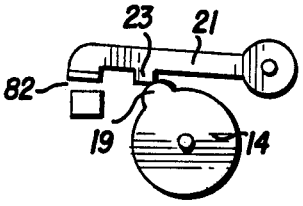
Figure 7:
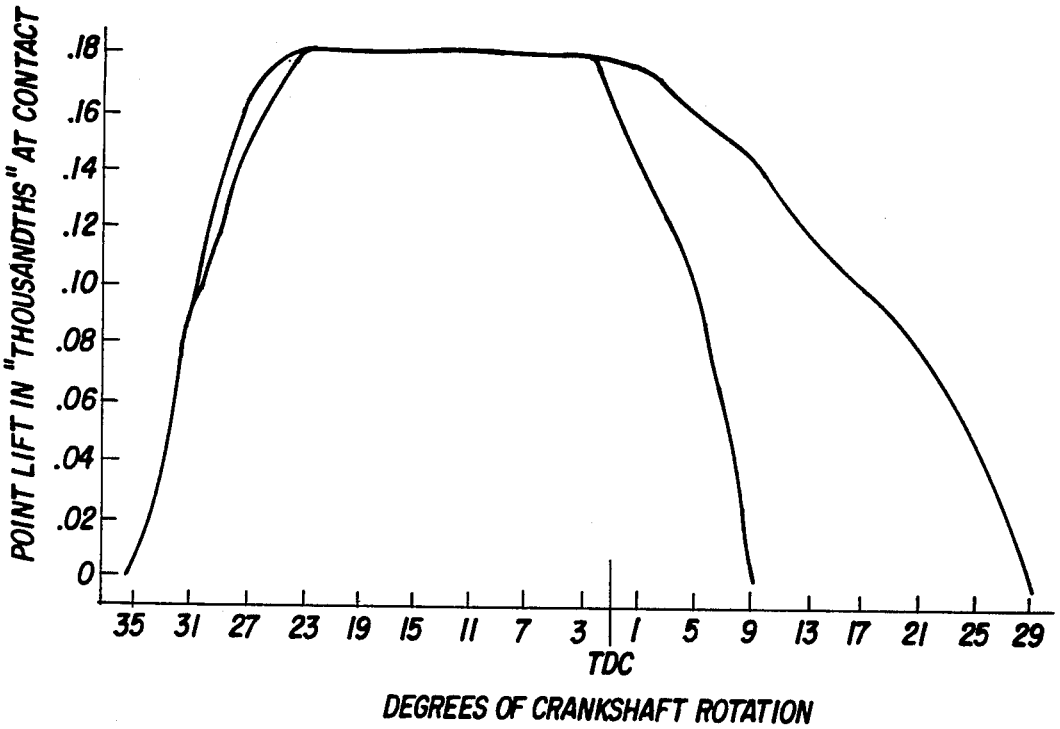
FIG. 7 is a graphic illustration of the opening and closing of the points of a breaker assembly of the invention as compared with a conventional cam and follower assembly.

Referring to FIGS. 6 and 7, the "point lift" or opening of the points has been plotted against the degrees of crank shaft rotation; it being kept in mind that it is desirable not to throw the point arm upward too rapidly lest a point bounce will result. In FIG. 7, both cams caused maximum opening at the desired angle before TDC depending upon the particular mode of the invention, i.e., opening at approximately 35°, however, since the cam is offset in the mode demonstrated in FIG. 7, the points are closed more rapidly utilizing the offset rubbing block of FIGS. 6-A-C.

In order to operate the engine in the manner it was designed, utilization of the improved cam and offset rubbing block of the pivotal arm arrangement is accommodated by adjustment of the individual point assembly support plates as will be described in detail relative to FIGS. 3–5, 8 and 9.

As illustrated in diagrams A, B, and C of FIG. 6, the rubbing block 23 of the pivoting arm of a point assembly is downstream or spaced from the center axis of rotation of the cam shaft 14. In A, the cam lobe 19 of the cam shaft, has not as yet struck the follower 23, and thus the points are still closed. In B of FIG. 6, the cam lobe has moved beyond its top dead center and is descending; it then strikes the follower 23 and displaces the follower 23. This results in an almost impact-type opening of the points i.e., the points are opened instantaneously and sharply. Since the points are opened sharply and suddenly, arcing is minimized between the points of an assembly. As seen in C, since the cam has struck the follower on its descent, closing of the points is also quite rapid as shown in FIG. 7, for example.

As is conventional, the condenser 28, which is connected to the fixed contact will accept the normal arcing charge; and as in conventional ignition circuits, when points are open, the condenser will be the line or path of least resistance for the current flowing to the primary circuit. When the condenser capacity is reached, the magnetic field starts to collapse; hastened by the condenser attempting to discharge after it reaches capacity, and when the magnetic field collapses due to the points having opened, an extremely high voltage is induced in the secondary circuit which in turn flows to the spark plug(s) to ignite the fuel.

A preferred construction, not shown, is the utilization of Mylar capacitors permanently attached to the points and which are appreciably smaller than conventional can-type condensers. In this construction, the points include permanently attached capacitors which lends itself to simplified tune-ups and aids to maintain the size of the breaker switch, even with dual points assemblies, at a minimum.

Referring to FIGS. 3–5 with respect to FIG. 1, it will be noted that a point base 20 is shown in FIG. 1. In FIGS. 3–5 there is illustrated a point base assembly 30 which replaces point base 20, and which facilitates mounting of a dual set of points, but permits each set of points to be adjusted independently of the other.

In FIG. 3, the assembly 30 including a lower plate 32 and upper plate 34 are shown in their normal assembled relationship. The lower plate 32, as seen in FIG. 4, comprises a central opening 35 through which the cam shaft protrudes and includes a plurality of arcuate or kidney-shaped slots 36, 38, and 40, as well as holes for accommodating retaining screws and/or the point assembly of FIG. 1. The plate 32 includes at its periphery, as is conventional, a V-notch 42 disposed in opposed relation to a plurality of vertical kerfs or grooves 44 on the inner periphery of the breaker switch housing. A screw driver blade B, or the like, can be inserted between the plate 32 and the switch housing to effect rotation of the plate relative to the fixed and pivotal points of a point assembly mounted on the plate 32.

Conventionally, in the past, dual sets of points were both mounted on the plate 20, and adjustment of one set of points was intended to automatically adjust the other set of points. This did not prove to be the case, and although one set of points, i.e., the front cylinder points, might be accurately adjusted, for various reasons, the rear set of points were not opening or closing in proper timed relation. Accordingly, when using but a single point plate for the dual point assemblies, the opening and closing of the second set of points in proper timed relation and at proper point gap was difficult.

As seen in FIG. 5, the second or upper point plate 34 has a cutout 46 which permits the point assembly, mounted on lower plate 32, to project in its proper oriented relationship with respect to the rotating cam. As is conventional, the upper plate includes a conventional V-notch 48 to permit the plate and the fixed point (of the upper point assembly), to be adjusted.

Figure 8:
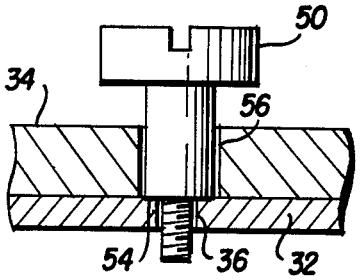
FIG. 8 is an enlarged fragmentary section taken on the plane of line 8—8 of FIG. 3.
Figure 9:
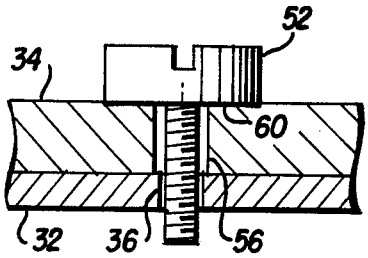
FIG. 9 is an enlarged fragmentary section taken on the plane of line 9—9 of FIG. 3.

Referring to FIGS. 3, 8 and 9, two different types of machine screws are provided as indicated at 50 and 52. When adjusting the points on plate 32, the bottom plate, shoulder 54 of screw 50 is backed off sufficiently to permit the adjustment of the point gap at its proper position to a cam lobe. The upper plate 34 has a kidney shaped slot 56 which is wider than underlying slot 36 of the lower plate 32. The screw 50 (see FIG. 8), is freely accommodated in slot 56, and when plate 32 and the points thereon are properly adjusted, the screw 50 is run down so shoulder 54 clamps the bottom plate and points thereon in a fixed adjusted position.

From FIG. 8, it will be observed that the machine screw 50 only clamps the lower plate 32 and the upper plate 34 (and the points thereon) can now be adjusted. The upper plate 34 includes kidney shaped slot 56, mentioned above, and a second kidney shaped slot 58, which is of the same size as slot 38 in the lower plate. After the top plate is adjusted, the screw 52 which has a wide shoulder 60 is run down and clamps plates 32 and 34 in relatively fixed relation. Next, the screw 50 is removed and replaced by a second clamp screw 52, i.e., which has a wide shoulder so plates 32 and 34 are clamped together at the areas bordering slots 36 and 56.

In this manner, point adjustment and/or timing is tailored for each of the respective front and rear cylinders, and with the system of superimposed plates it has been possible to adjust point gap within ±0.003 and allowing adjustment while the engine is running.

In motorcycle engines, the problem of firing during an open exhaust valve is not particularly serious although undesirable. However, the problem manifests itself when the rear cylinder was being provided an igniting spark when its intake valve is still partially open. This not only causes rough running and inefficiency, but increases the possibility of back firing in the intake, as well as engine failure during stops, i.e., at stop signs and signals, for example and, the fire hazards of igniting the carburetor and air filter assembly.

To substantially insure sufficient current and current separation to both sets of plugs, dual coils previously have been provided, i.e., one for each cylinder.

A typical battery-ignition circuit includes a battery, ignition switch, primary circuit, ignition coil, condenser, contact points, secondary circuit, spark plug(s) and grounds for the battery, condenser, points and plug(s). The basic ignition circuit mentioned above was duplicated using a second ignition coil and attempts were made to operate each cylinder on its own ignition circuit using a single cam and/or multiple lobes on a single cam.

Figure 10B:
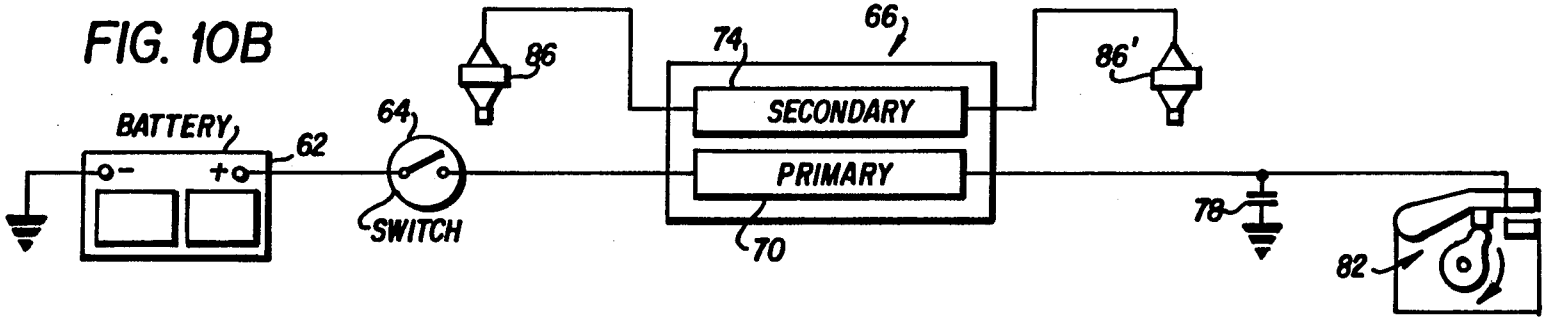

In order to afford a more intense voltage or fire power to insure adequate and complete combustion after a compression stroke, means are provided to increase the primary coil saturation of each of the coils over a period substantially twice as long as was previously provided. Referring to FIGS. 10A and 10B, the battery 62 is suitably connected through a switch 64 by a Y-connection, i.e., parallel-connected to coils 66 and 68 each including primary and secondary coils 70 and 72, and 74 and 76, respectively. The primary coils are connected to capacitors (condensers) 78 and 80, respectively and to cam operated point assemblies 82 and 84. The capacitors are grounded through the points, and each coil secondary is connected to a suitably grounded spark plug (or plugs) 86 and 88, respectively.

It will be appreciated that the point assemblies 82 and 84 are opened and closed in sequence. As current flows from the battery to the primary coil, and since the coil normally includes a plurality of soft iron laminations, a magnetic field is built up in the core of the coil. When the points are opened, the circuit through the primary is broken and the current tries to follow the path of least resistance and thus the condenser (capacitor) is charged. When the condenser reaches its capacity, it starts to discharge and in conjunction with the collapsing magnetic field an extremely high voltage is generated in the secondary and is directed to the spark plug(s).

In FIG. 10A Mode 1, the primary winding of each of the respective coils is connected to a lead from the secondary winding of the same coil, i.e., since the points controlling the other coil are closed while the other is opened the closed points complete the secondary circuit to ground. To say this in another way, in a two coil ignition system, one spark plug lead is connected to the primary windings of the same coil thus resulting in increased secondary voltage. Thus, during each cycle, the number of primary windings is "increased"; the closed points complete the secondary circuit to ground. The magnetic flux collapses around both the primary and secondary so that they both act to field voltage.

Using the adjusting system described, and a stock two-lobe cam, with valve timing advanced 360° as measured at the crank shaft whereby the rear cylinder fires at 80° before TDC (front) and the front cylinder fires at 35° before TDC. This arrangement provides single cylinder engine characteristics to the engine, and an appreciable increase in rear wheel torque and traction as compared with conventional stock adjustment of the rear cylinder at 430° before TDC and the front cylinder at 35° before TDC.

In Mode 1 there is disclosed an arrangement in which a single spark plug is provided for each cylinder; these have been identified as "front cyl." and "rear cyl." on FIG. 10A. In Mode 1 by using a single plug per cylinder, we provide a particularly high voltage facilitating kick-starting; no-stopping of the engine at stops; and preventing of firing back through to the carburetor when the intake valve is opened.

From the description provided with respect to FIGS. 3–5, 8 and 9, each set of points on each plate 32 and 34 will have been independently adjusted.

Mode 2 comprises disconnecting leads 90 and 92 of FIG. 10A and connecting a second spark plug 86' and 88' to the secondary coils of the respective coils as shown in dotted lines of FIG. 10A. This affords dual plug ignition so that there is no firing on a "dead" cylinder. This is a general application arrangement.

Mode 3 comprises the provision of dual spark plugs for each cylinder with extended spark duration. One plate, i.e., the points thereon, is connected to the primary winding of coil 66, while the other set of points are connected to the primary winding of coil 68. With the proper adjustment, as will be detailed below, a high RPM and high H.P. arrangement, even though the rear spark plugs of each of the cylinders fire during the intake stroke of the engine, because the engine is firing on a high R.P.M. ignition to the filters or carburetor system would generally not occur with the adjustment versatility of the dual, superimposed plates, in Mode 3 ignition is substantially improved during "kick-starts" and H.P. was increased to about 12½%.

Another mode of operation is that in which a single set of points are provided using a twin tower coil; see FIG. 10B. In this instance the single plate 32, i.e., the bottom plate of FIG. 4 is used, of course, the rapidly opening and closing of the single set of points is afforded by using the offset rubbing block on the pivotal arm as was described relative to FIGS. 6*a*–6*c*.

Although mention is made of using a single and/or double lobe cam to control the breaker points, although not shown, a pair of separate cam elements can be provided on the cam shaft to control each of the respective breaker point assemblies.

Referring to the various modes of operation utilizing the disclosed improvements, the following advance of firing before TDC is as follows:

Modes 1 and 4: 35° BTDC
Mode 2: 29° BTDC
Mode 3: 29° and 25° BTDC A single lower point assembly base can be used where single point assemblies are dictated by the production or stock installations; per Mode 4.

Although the inventions have been described with reference to particular embodiments thereof, it will be understood by those skilled in the art that numerous modifications may be made without departing from the scope and spirit of the invention, accordingly, all modifications and equivalents may be resorted to which fall within the scope of the invention as claimed.

What is claimed is:

1. In an ignition system for an internal combustion engine having at least one cylinder with an associated spark plug and at least power and exhaust strokes associated with such engine, ignition coil means and circuit breaker switch means in association with a cam shaft driven in timed relation to an engine crankshaft causing said spark plug to fire in advance of a power stroke, the improvement comprising:

means for insuring rapid opening and closing of a displaceable point assembly including:

cam lobe means on said cam shaft;

a point base assembly for supporting dual point assemblies in operative relation to said cam lobe means of said cam shaft;

said point base assembly comprising a pair of upper and lower superimposed plates, each of said plates respectively supporting a point assembly;

said upper plate having a portion removed for permitting the point assembly mounted on said lower plate to be operatively and independently adjusted with respect to said cam lobe means; and, means for independently adjusting the respective point assemblies with respect to each other;

said plates including overlying, arcuate slots for accommodating lock means projecting therethrough and permitting rotation of said plates relative to the axis of rotation of the cam shaft, the uppermost plate having at least one slot of larger dimensions than the slot of the lower plate for accommodating therethrough a lock means to permit independent locking of the lower plate after it has been adjusted.

* * * * *